United States Patent [19]

Tomma et al.

[11] Patent Number: 4,601,435

[45] Date of Patent: Jul. 22, 1986

[54] WINDER ARRANGEMENT

[75] Inventors: Kauko Tomma, Helsinki; Jarmo Malmi, Järvenpää both of Finland

[73] Assignee: Oy Wartsila Ab, Helsinki, Finland

[21] Appl. No.: 623,952

[22] Filed: Jun. 25, 1984

[30] Foreign Application Priority Data

Jul. 7, 1983 [FI] Finland ..... 832497

[51] Int. Cl.[4] ..... B65H 18/16; B65H 35/02; B65H 18/10

[52] U.S. Cl. ..... 242/56.4; 242/65

[58] Field of Search ..... 242/56.4, 65, 66

[56] References Cited

U.S. PATENT DOCUMENTS

| | | | |
|---|---|---|---|
| 297,775 | 4/1884 | Firm | 242/65 |
| 1,620,044 | 3/1927 | Stocker | 242/65 |
| 1,881,781 | 10/1932 | Malkin | 242/65 |
| 2,460,694 | 2/1949 | Haswell | 242/56.4 |
| 2,711,861 | 6/1955 | Heygel et al. | 242/65 |
| 2,790,497 | 4/1957 | Heygel et al. | 242/56.4 X |
| 3,734,307 | 5/1973 | Degelleke | 242/65 X |
| 3,949,948 | 4/1976 | Tomma | 242/65 X |

FOREIGN PATENT DOCUMENTS

| | | | |
|---|---|---|---|
| 269854 | 10/1926 | United Kingdom | 242/65 |

*Primary Examiner*—John M. Jillions

*Attorney, Agent, or Firm*—Dellett, Smith-Hill and Bedell

[57] ABSTRACT

In an arrangement for forming rolls from a running web, the web is slit in its longitudinal direction and wound into a plurality of rolls, all having the same rotation direction during winding. The arrangement comprises means providing a peripheral as well as a central roll support force acting on the rolls during winding. The arrangement is so dimensioned that, due to the increase of the roll diameter during winding, the ratio of the peripheral support force and the central support force of a roll undergoes a substantial change merely as a result of the geometrical construction features of the arrangement. In the final phase of the winding of a roll, the central support force of the roll is considerably higher than the peripheral support force of the roll.

13 Claims, 3 Drawing Figures

WINDER ARRANGEMENT

Figure 1:
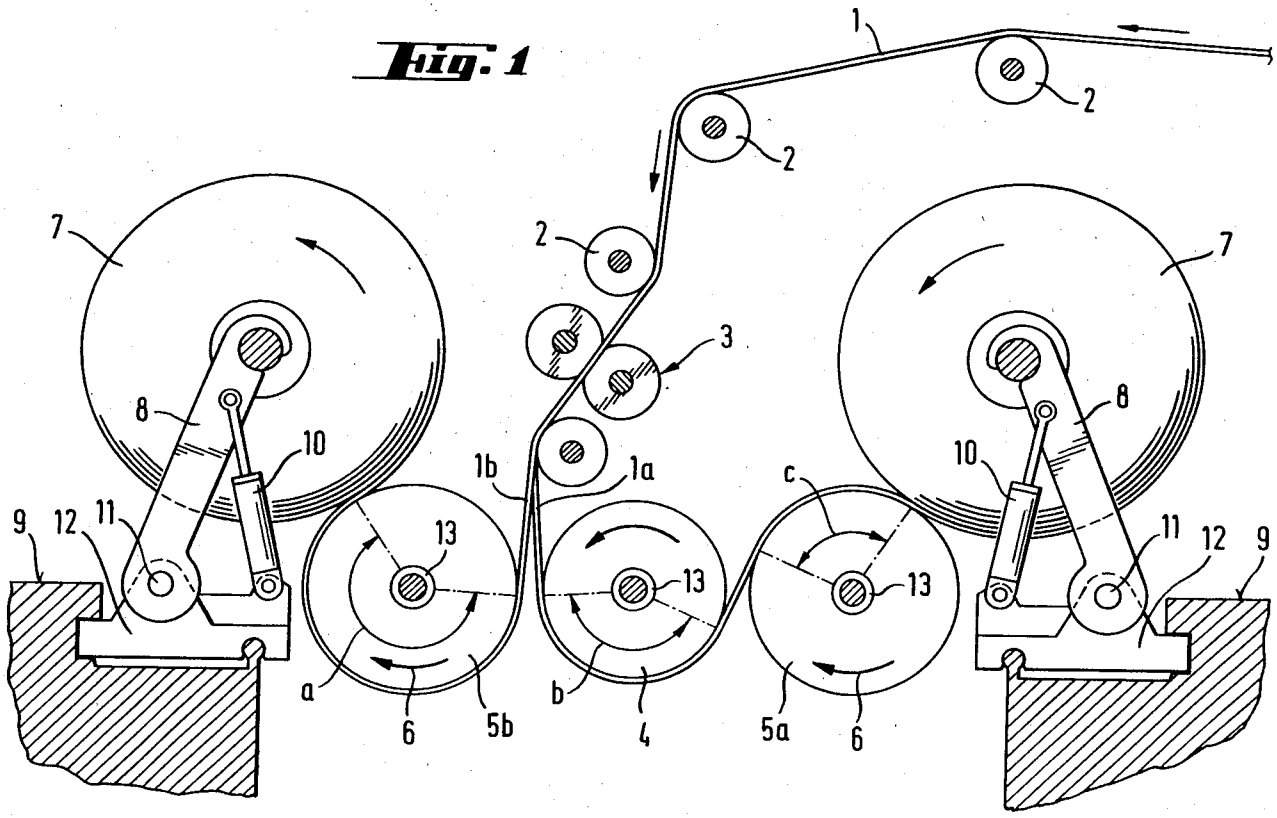

The invention relates to an arrangment for forming rolls from a web by slitting it in its longitudinal direction and winding the slit web portions into a plurality of rolls by using the same rotation direction for all said rolls during winding, said arrangement comprising means giving said rolls peripheral as well as central support during winding.

A slitter-winder is a winder, in which a paper web is slit in its longitudinal direction and is simultaneously wound into several rolls. In known slitter-winders all rolls receive peripheral support from the same support drum. The necessary roll carrying and handling means make it impossible to form adjacent rolls from adjacent web portions, instead every second roll is wound at the opposite side of the support drum. This means that there are two differently situated groups of rolls. The web portions led to each of the two roll groups have to follow different paths. This results in that the winding process is slightly different in the two roll groups. Attempts have been made to eliminate this harmful difference by using two support drums side by side, for instance, as shown in patent specification U.S. Pat. No. 2,460,694. It has thereby been possible to make the winding process practically uniform for all rolls, that is, having equally large contact angles between both web portions and the support drums as well as the same winding direction in all rolls. A common winding direction is important in view of the further roll handling, because the winding direction must be taken into account when the roll is packed. If a winder produces rolls wound in different directions, one must either arrange two separate packaging lines or turn the rolls of one group by 180° before delivering them to packaging.

A most important factor in a winder is the control of the roll formation. The formation of a big paper roll is a technically difficult operation. An incorrect tension distribution in the roll may result in total winding failure. Several phenomena are known, which either make a roll unusable or considerably lowers its value. The control of the winding process is more difficult the larger are the rolls that are made. The roll buyers, however, desire as big rolls as possible. In a printing machine, for instance, each roll replacement causes considerable production disturbances and decreases the efficiency of the printing process. For this reason the aim in winding rolls is to make them as big as possible, even at the cost of an increasing risk of roll failure. If, for instance, the diameter of a roll can be increased from 1 m to 1.25 m, the roll comprises over 50% more web length. Hence, it is extremely important, that the winding process is so well controlled, that maximizing the roll size is possible.

The roll formation is usually influenced by adjusting the force resulting from the peripheral support of the roll, that is, the contact force or nip pressure between the roll and its suppport drum. The object of the invention is to provide a winder in which this adjustment normally takes place automatically as a result of the geometrical proportions of the winder construction, so that no external force is needed for influencing the roll support force. However, it is suitable to have facilities enabling the use of an external force, if it is feasible that unnormal winding control has to be used in special cases.

The characteristic features of the invention are disclosed in claim 1. By constructing the winder in this manner, the desired self-adjustment is obtained, but this does not exclude the possibility of influencing the winding process by using external force, if occasionally necessary. The essence of the invention is in that a favourable load distribution is obtained entirely by the constructional geometry of the arrangement, which automatically adjusts the ratio of the peripheral load and the central load, so that an optimum winding result is obtained. The invention is primarily intended for the winding of filled or coated printing paper. The density of such paper is about 1–1.25 kg/dm$^3$. In winding such paper a very good winding result is obtainable up to a roll diameter of 1.25 m. If a paper web with higher density is wound, the geometry of the winder should be altered so that a higher proportion of the roll weight is taken up by the central support of the roll. If a paper web with a lower density is wound, the winder geometry should be altered so that the proportion of the peripheral support increases. In practice, alteration of the winder construction geometry is cumbersome, and hence, it is more practical to apply an external auxiliary force in order to obtain a changed load distribution.

Patent specification U.S. Pat. No. 3,188,016 shows a winder having a construction geometry resembling that of the invention. In this known device, however, no use is made of the construction geometry for obtaining self-adjusting of a winding process, instead the roll support pressure is kept constant at the contact point of the roll and the support drum. This is obtained by using power cylinders loading the roll. Moreover, rolls of different groups are wound in different directions in the known device, and furthermore, the contact angle between the web and the support drums is not the same for the two roll groups. Hence, the problem forming the basis of the invention has neither been recognized nor solved in this known device.

In a preferred embodiment of the invention, such a construction geometry is used that the central support of the roll is at least 150% of its peripheral support at the final phase of the winding. This result is obtainable, if the center of the support drum of a roll and the support and pivot point of the swinging support arms providing the central support of the roll are at the same horizontal level and the distance between said pivot point and the center of said support drum is 70% of the diameter of the finished roll, the support drum diameter being 60% and the swinging support arm length being 70% of said roll diameter.

In order to obtain an optimum winding result, it is important, that the winder in its entirety is designed for making it possible to obtain good winding results. One feature of importance is that the angle of contact between each web portion and the drum or drums over which it runs, is equal for all roll forming web portions. The easiest way to obtain this is to use two support drums rotating in the same direction and, at one side of the winder, an auxiliary drum, over which the web portions being led to that side of the winder pass before they reach the support drum. Thus, at one side of the winder, the web passes directly to a support drum, and, at the opposite side of the winder, the web is first led over an auxiliary drum and then to a suppport drum. The contact angle between the web and the support drum at one side of the winder, and, at the other side of the winder, the sum of the contact angles between the web and the auxiliary drum plus its associated support drum should be at least substantially equal. By this means a uniform winding result is obtained in all rolls formed simultaneously in the winder.

It is favourable when applying the invention to journal all heavy parts of the arrangement at the floor level. Thus, for instance, the roll support arms, the support drums and the auxiliary drum may all be journalled at the same level. It has been empirically found that the optimum support drum diameter is about 750–800 mm, when winding printing paper. The auxiliary drum may be made smaller than the support drums, for keeping its production costs down, but it should not be made so small that its rotation speed becomes too high. The rotation speed of any drum should not exceed 75% of its natural frequency.

It is preferred that the web is led from above into the winder, because web observation during the winding process and the web treating at the beginning of the winding are then considerably easier to perform than if the web comes from below.

The winding process may also be influenced by external means. Already mentioned, the ratio of the central and the peripheral support may be influenced by, for instance, power cylinders which influence the roll support arms providing the central support. This can be done by letting the external force act either against or in the same direction as the gravity of the roll. The winding process may also be influenced by applying a turning moment to the roll center. Further, a rider roll or a rider roll combination may be use to load the middle portion of axially long rolls, whereby harmful roll deflection, appearing especially during the initial winding phase, is eliminated. The use of a turning moment as well as a rider roll are known per se.

Figure 2:
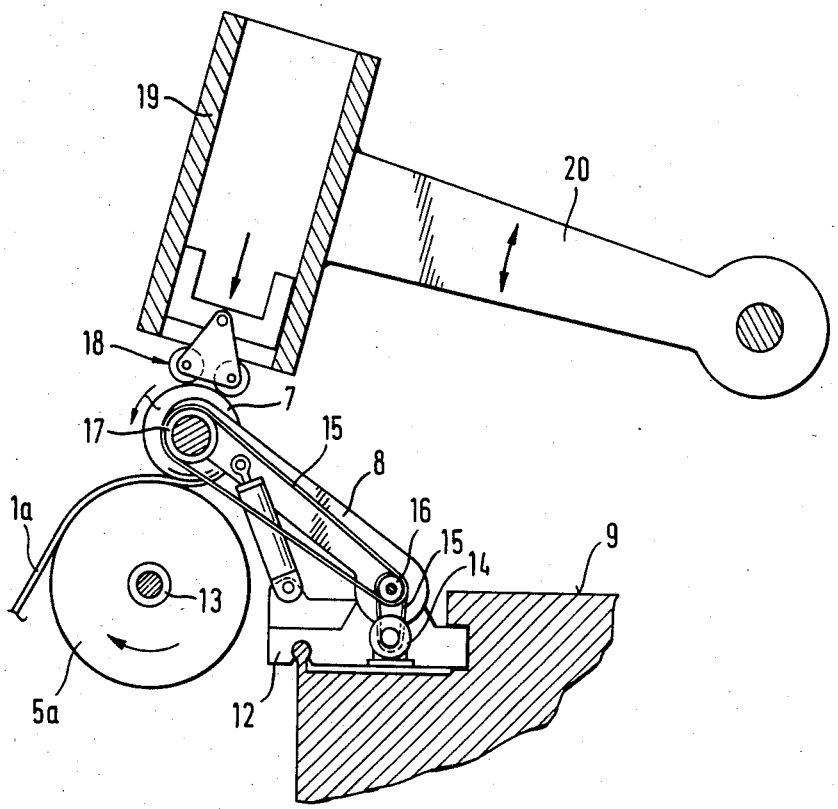
Figure 3:
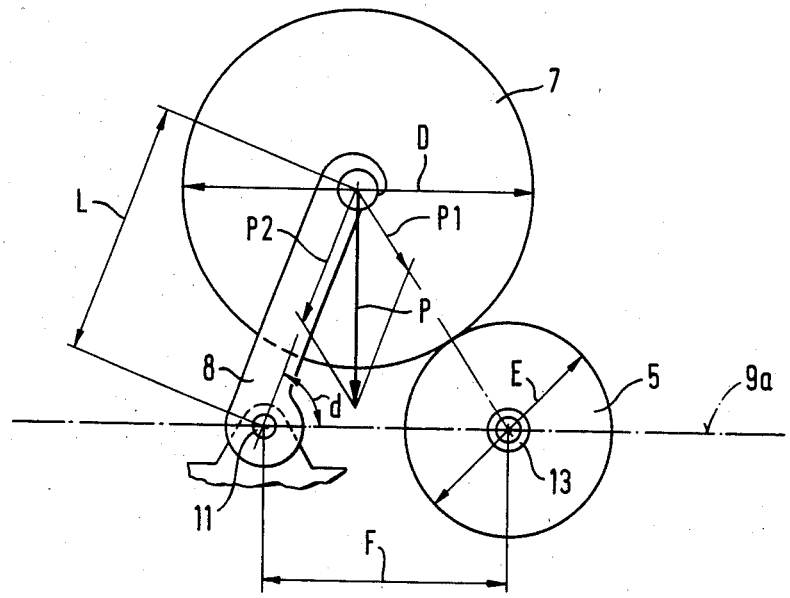

The invention will now be described, by way of example, with reference to the accompanying drawing, in which FIG. 1 is a side view, partly in section, of an embodiment of a winder according to the invention, FIG. 2 shows a modification of the right-side winder station of the winder of FIG. 1, FIG. 3 shows schematically the static forces acting in a winder according to the invention.

In the drawing, 1 indicates a web to be wound into rolls. The web passes over some guide rollers 2 to a slitter device 3, in which rotating slitter knives slit web 1 into several portions, of which two adjacent portions 1*a* and 1*b* are shown in FIG. 1. Web portion 1*a* passes via an auxiliary drum 4 to a right-side support drum 5*a*, whereas web portion 1*b* is directly brought to a left-side support drum 5*b*. Support drums 5*a* and 5*b* rotate in the same direction shown by arrows 6. The wound rolls are formed with peripheral support from the support drums and central support arms 8, carrying a central shaft of the rolls. Each roll is carried by two support arms 8, one at each end of the roll. When the roll has been wound to its full diameter, the roll is placed on a floor 9 by power cylinders 10 swinging support arms 8 away from the support drum of the roll. Support arms 8 turn around their journal point 11. Each support arm 8 is attached to a sledge 12 movable in the axial direction of the rolls. The distance between the two support arms of a roll is, by moving the sledges, adjusted to correspond to the desired axial length of the roll. A normal axial length of a roll is about 1 m, but sometimes rolls are wound having an axial length of only 40 cm, whereas the maximum axial roll length is in practice slightly over 260 cm. The weight of a full size roll of this length is about 4 tons.

Support drums 5*a* and 5*b* are identical and are together with auxiliary drum 4 journalled at the same level as support arms 8, that is, at the floor level 9 of the arrangement. The complete journalling of the drums is not shown, it is only indicated by bearings 13. The angle of contact between web portion 1*b* and support drum 5*b* is a. Web portion 1*a* has two contact angles, one, b, with auxiliary drum 4 and another, c, with support drum 5*a*. In order to obtain similar winding results in both rolls 7, the contact angles of the web portions are so arranged that $a=b+c$.

Some auxiliary devices are shown in FIG. 2, by means of which the winding results can be influenced in a manner known per se. It is known that a turning moment transmitted to the central shaft of a roll has a favourable effect on the winding result. The aim is usually to maintain a constant moment during the entire winding. The applied moment is usually higher the greater is the axial length of the roll. For transmitting the moment to the roll shaft, there is a motor 14 attached to sledge 12 of one of the support arms, which motor, via transmission belts 15 and belt pulleys 16 and 17 transmits a turning moment to the central shaft of roll 7. The central shaft of a roll is usually a tube of steady board with metal end inserts, but a throughgoing steel shaft can be used as well.

In the initial winding phase, the roll 7 is small and has a low stiffness, especially if it has a considerable axial length. There may then be a deflection in the roll, as a result of the load caused by the forces acting on it. This deflection, which is directed away from the support drum forms a common problem in winding of rolls supported at their ends. The roll deflection may be compensated by applying, in the middle of the roll between its ends, a rider roll or a rider roll combination 18, which applies a load on roll 7 in a direction towards the support drum. When a sufficient roll stiffness has been reached, the rider roll load and the rider roll are removed. In the embodiment shown, the rider roll combination 18 moves along a linear guide 19, and, by means of a swing arm 20, the entire guide construction has been made turnable away from the roll 7.

FIG. 3 shows the static forces acting on roll 7. The roll weight P is divided into two weight components P1 and P2, of which P1 corresponds to the peripheral support of the roll and P2 corresponds to the central support of the roll. As obvious from FIG. 3, the ratio of the forces P1 and P2 is dependent on the inclination angle d of roll support arm 8.

In the embodiment shown, force P2 is considerably higher than the force P1 in the final phase of the winding. At that time force P2 should preferably be at least 150% of force P1. The best result is achieved if journalling point 11 of the support arm and journalling point 13 of support drum 5 are at the same level 9*a* and the diameter E of the support drum is 60% of the diameter D of a complete roll and the length L of support arm 8 is 70% of the roll diameter D, the distance F between the journalling points 11 and 13 being 70% of the roll diameter D. Good result are obtained with this construction geometry when winding the printing paper grade mentioned earlier. The result remains good, even if the ratio of forces P2 and P1 deviates about 10% from the result obtained by using the dimensioning stated above, but preferably any deviation should not exceed 5%.

From FIG. 3 it can easily be seen, by drawing support arm 8 in a position corresponding to the initial phase of the winding of roll 7, when its diameter is still very small, that in that phase of the winding, the peripheral support force P1 is about twice the central support force P2.

The invention is not limited to the embodiments shown, but several modifications thereof are feasible within the scope of the attached claims.

We claim:

1. Winder apparatus for forming rolls from a running web by slitting the web longitudinally into at least first and second web portions and winding the web portions into an equal number of rolls, the winder apparatus comprising at least first and second winders for receiving the first and second web portions respectively, and each winder comprising first and second means for supporting the weight of a roll at its center and at its periphery respectively, whereby a central support force and a peripheral support force are provided for the roll, the center of the roll moving away from the second means as the winding progresses and the roll becomes larger, and each winder also comprising means for guiding movement of the center of the roll away from the second means in a direction such that the ratio of the peripheral support force and the central support force undergoes a substantial change during such movement, said peripheral support force being at least as large as the central support during the initial phase of the winding and the central support force being substantially larger than the peripheral support force during the final phase of the winding, the second means of each winder comprising a roll support drum and the winder apparatus comprising an auxiliary web leading drum associated with the second winder, and means for leading the first web portion over the roll support drum of the first winder and the second web portion over both the auxiliary drum and the roll support drum of the second winder so that the first and second web portions are wound into the respective rolls in the same rotation direction, the web contact angle between the first web portion and the roll support drum of the first winder being substantially equal to the sum of the web contact angles between the second web portion and the auxiliary drum and between the second web portion and the roll support drum of the second winder.

2. Apparatus according to claim 1, wherein the auxiliary drum and the roll support drums of the first and second winders are each disposed substantially horizontally and are located at substantially the same vertical height, and the auxiliary drum is located between the roll support drums.

3. Apparatus according to claim 2, wherein the auxiliary drum is located at the level of a floor adjacent the apparatus.

4. Apparatus according to claim 1, wherein the auxiliary drum has a smaller diameter than each of the support drums.

5. Apparatus according to claim 1, wherein the means for guiding movement of the center of the roll comprise means for causing the center of the roll to move along a path having a horizontal component.

6. Apparatus according to claim 5, wherein the first means of each winder comprise a support arm, and the means for guiding movement of the center of the roll comprise means defining a pivot axis for the support arm, whereby the support arm pivots about said pivot axis as the winding progresses and the roll becomes larger.

7. Apparatus according to claim 6, wherein, for each of the first and second winders, the diameters of the roll support drums are substantially equal, the lengths of the support arms are substantially equal, the distances between the pivot axes of the support arms and the central axes of the roll support drums are substantially equal, and the relative heights of the pivot axes of the support arms and the central axes of the support drums are substantially equal.

8. Apparatus according to claim 6, comprising power means for moving said first means away from the roll support drum to a roll delivery position, said power means being operable to influence the support provided by the roll support drum during roll winding.

9. Apparatus according to claim 6, wherein the pivot axis is at substantially the same vertical level as the axis of the roll support drum and the length of the support arm, the diameter of the support roll and the distance between the pivot axis and the axis of the roll support drum are all less than the diameter of the complete roll.

10. Apparatus according to claim 1, comprising power means for moving said first means to a roll delivery position, said power means being operable to influence the support provided by the second means during roll winding.

11. Apparatus according to claim 1, wherein the auxiliary drum and the roll support of the first and second winders are each disposed substantially horizontally, and the apparatus comprises means for leading the web in a downward direction towards the winder apparatus.

12. Apparatus according to claim 1, in which the central support force is at least 1.5 times the peripheral support force during the final phase of the winding.

13. Apparatus according to claim 1, wherein the relationship between the distance of the center of the roll from the roll support drum and the ratio of the peripheral support force and the central support force is substantially the same for the first and second winders.

* * * * *